US007593656B2

(12) United States Patent
Boness et al.

(10) Patent No.: US 7,593,656 B2
(45) Date of Patent: Sep. 22, 2009

(54) METHOD AND DEVICE FOR CONTROLLING REGISTRATION

(75) Inventors: Jan D. Boness, Bad Bramstedt (DE); Ingo K. Dreher, Kiel (DE); Heiko Hunold, Wattenbeck (DE); Karlheinz Peter, Molfsee (DE); Stefan Schrader, Kiel (DE)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 11/847,868

(22) Filed: Aug. 30, 2007

(65) Prior Publication Data

US 2008/0050132 A1 Feb. 28, 2008

Related U.S. Application Data

(63) Continuation of application No. 11/577,675, filed on Jan. 29, 2009.

(51) Int. Cl.
*G03G 15/00* (2006.01)

(52) U.S. Cl. ..... 399/49; 399/301; 399/394

(58) Field of Classification Search ..... 399/49, 399/301, 394; 347/116

See application file for complete search history.

(56) References Cited

U.S. PATENT DOCUMENTS

| | | | | |
|---|---|---|---|---|
| 5,488,458 | A * | 1/1996 | Benedict et al. | |
| 5,828,937 | A | 10/1998 | Aerens et al. | |
| 6,246,857 | B1 * | 6/2001 | Tanaka | 399/301 |
| 2002/0001491 | A1 | 1/2002 | Buch et al. | |
| 2004/0190920 | A1 | 9/2004 | Engeln et al. | |

FOREIGN PATENT DOCUMENTS

| | | |
|---|---|---|
| EP | 0478005 | 6/1995 |
| EP | 0848300 B1 | 6/1998 |
| WO | WO 2006045487 A1 * | 4/2006 |

* cited by examiner

*Primary Examiner*—David M Gray
*Assistant Examiner*—Laura K Roth
(74) *Attorney, Agent, or Firm*—Donna P. Suchy

(57) ABSTRACT

A device and a method using a printing device and system for printing sheets whereby, for each sheet, at least one register mark per color printing unit of the multi-color printing machine is produced, assigned to said sheet and defined with respect to its position, so that in duplex printing register marks are applied to each side. The position of each mark is determined by analyzing the position of the mark assigned to the appropriate previous recto or verso sheet.

16 Claims, 4 Drawing Sheets

METHOD AND DEVICE FOR CONTROLLING REGISTRATION

CROSS-REFERENCE TO RELATED APPLICATION

This is a continuation of application Ser. No. 11/577,675 filed Jan. 29, 2009, which claims priority of PCT/EP2005/011186 filed Oct. 18, 2005 which claims priority of DE 102004051293.0 filed Oct. 20, 2004.

FIELD OF THE INVENTION

The invention relates generally to the field of printing, and more particularly digital color reproduction systems that incorporate a printing device and system for printing sheets with accurate registration with respect to its position, including in duplex printing.

BACKGROUND OF THE INVENTION

Digital color reproduction printing systems typically include digital front-end processors, digital color printers, and post finishing systems (e.g., UV coating system, glosser system, laminator system, etc). These systems reproduce original color onto substrates (such as paper). The digital front-end processes take input electronic files (such as PDF or postscript files) composed of imaging commands and/or images from other input devices (e.g., a scanner, a digital camera) together with their own internal other function processes (e.g., raster image processor, image positioning processor, image manipulation processor, color processor, image storage processor, substrate processor, etc) to rasterize the input electronic files into proper image bitmaps for the printer to print. An operator may be assisted to set up parameters such as layout, font, color, paper, post-finishing, and etc among those digital font-end processes. The printer (e.g., an electrographic printer) takes the rasterized bitmap and renders the bitmap into a form that can control the printing process from the exposure device to writing the image onto paper. The post-finishing system finalizes the prints by adding finishing touches such as protection, glossing, and binding etc.

In an electrophotographic modular printing machine of known type, for example, the Eastman Kodak NexPress 2100 printer manufactured by Eastman Kodak, Inc., of Rochester, N.Y., color toner images are made sequentially in a plurality of color imaging modules arranged in tandem, and the toner images are successively electrostatically transferred to a receiver member adhered to a transport web moving through the modules. Commercial machines of this type typically employ intermediate transfer members in the respective modules for the transfer to the receiver member of individual color separation toner images. In other printers, each color separation toner image is directly transferred to a receiver member.

Electrophotographic printers having multicolor capability are known to also provide an additional toner depositing assembly for depositing clear toner. The provision of a clear toner overcoat to a color print is desirable for providing protection of the print from fingerprints and reducing certain visual artifacts. However, a clear toner overcoat will add cost and may reduce the color gamut of the print; thus, it is desirable to provide for operator/user selection to determine whether or not a clear toner overcoat will be applied to the entire print. In U.S. Pat. No. 5,234,783, issued on Aug. 10, 1993, in the name of Yee S. Ng, it is noted that in lieu of providing a uniform layer of clear toner, a layer that varies inversely in thickness according to heights of the toner stacks may be used instead as a compromise approach to establishing even toner stack heights. As is known, the respective color toners are deposited one upon the other at respective locations on the receiver member and the height of a respective color toner stack is the sum of the toner contributions of each respective color and so the layer of clear toner provides the print with a more even or uniform gloss.

In U.S. Pat. No. 7,236,734 issued Jun. 26, 2007, in the names of Yee S. Ng et al., a method is disclosed of forming a print having a multicolor image supported on a receiver member wherein a multicolor toner image is formed on the receiver member by toners of at least three different colors of toner pigments which form various combinations of color at different pixel locations on the receiver member to form the multicolor toner image thereon; forming a clear toner overcoat upon the multicolor toner image, the clear toner overcoat being deposited as an inverse mask; pre-fusing the multicolor toner image and clear toner overcoat to the receiver member to at least tack the toners forming the multicolor toner image and the clear toner overcoat; and subjecting the clear toner overcoat and the multicolor toner image to heat and pressure using a belt fuser to provide an improved color gamut and gloss to the image.

Color inaccuracies, including misregistration, occur in all printing systems, including the electrophotographic printing systems. The system environment can change when components, such as the fuser roller, change their operational characteristics over time. Typically linearization processes are used to re-calibrate the printer system, in conjunction with the use of other devices, so that the digital front-end processors are more independent from printer behavior changes. However, in the whole color reproduction printing system, which includes both printer and post finishing system (e.g., UV coater, glosser, and etc), the linearization process alone cannot fully correct the whole color reproduction system variability with out effective controls and controlling systems, such as effective registration devices and color measurement systems. Without these controlling systems the resultant colors may be incorrectly shifted (for example, red shift or green shift), and the resulting reproduction may be perceived as unacceptable to the customer. It is important to make corrections and adjustments to recreate the desired perceived images. However, making these changes can be time consuming and expensive using the current control systems, as well as ineffective.

The present invention overcomes this shortcoming by making image control, that incorporates a registration system and related method, more efficient and accurate and allowing it to occur automatically during the printing run. The following invention solves the current problems with image location control in a wide variety of situations, including duplex printing.

SUMMARY OF THE INVENTION

In accordance with an object of the invention, both a device and a method are provided for improving the quality of prints using a printing device that includes a system and related method for controlling registration whereby, for each sheet, at least one register mark per color printing unit of the multicolor printing machine is produced, assigned to said sheet and defined with respect to its position. These color marks are applied to a substrate or to a support for said substrates or sheets. In duplex printing it can be applied to a sheet by recto and verso printing and register marks can be applied for each side, so that the register marks are assigned to the respective side of the sheet and determined with respect to their position.

DETAILED DESCRIPTION OF THE INVENTION

Figure 1:
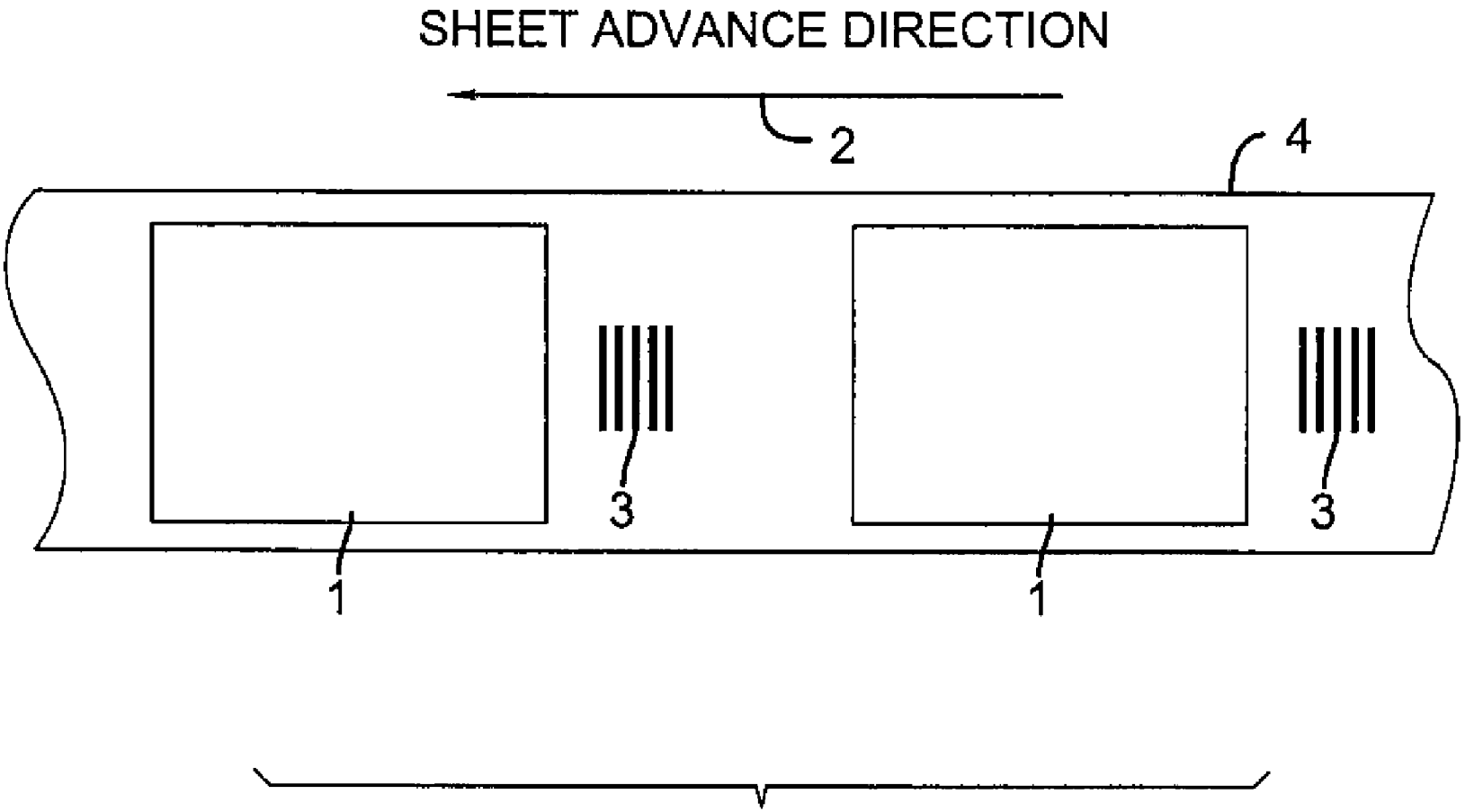
FIG. 1 is a schematic showing sheets on a transport belt in a printer.

The present description will be directed in particular to elements forming part of, or cooperating more directly with, apparatus and methods in accordance with the present invention. It is to be understood that elements not specifically shown or described may take various forms well known to those skilled in the art. The invention relates to a method of controlling registration with a register, such as a circumferential register, in a digital multi-color printing machine for printing sheets during a printing process. In the registration in an electrophotographic (EP) printing machine there is for each sheet at least one register mark per color printing unit of the multi-color printing machine. The registration mark is produced and assigned to each sheet and defined with respect to its position, preferably relative to one of the color marks itself. The color marks are applied preferably to a support for the sheets and preferably downstream of the respectively associated sheet, and, based on the determination of the position of the register marks of a sheet, the circumferential register of at least one sheet being controlled, said sheet following the sheet associated with said determined register marks downstream of the printing process.

Furthermore, the invention relates to a device for controlling the circumferential register in a digital multi-color printing machine for printing sheets during a printing process, in particular in an electrophotographically operating printing machine, whereby, for each sheet, at least one register mark per color printing unit of the multi-color printing machine is produced, assigned to said sheet and defined with respect to its position, preferably relative to one of the color marks itself, said color marks being applied preferably to a support for said sheets and preferably downstream of the respectively associated sheet, and, based on the determination of the position of the register marks of a sheet, the circumferential register of at least one sheet being controlled, said sheet following the sheet associated with said determined register marks downstream of the printing process, said device comprising at least one monitoring and control arrangement for detecting register marks, for determining at least relatively the positions of said register marks and for controlling the color printing units based on the aforementioned register mark positions, preferably for carrying out the aforementioned method.

Conventionally, for the purpose of accurately registered printing, a series of control and pilot algorithms were developed which correct the influence of different interfering factors. Almost all of these methods are based on the principle that register marks are printed on a transport belt and read by a registration sensor. Data yielded in this manner are either used directly following completed low-pass filtering (as a so-called delay drift control) or are processed further, in particular, in special calibrating/printing sequences, in order to compute specific corrective parameters. EP-A-1 156 384 A2 (paragraph 28ff) describes a method of the aforementioned type.

FIG. 1 shows a plan view of sheets on a transport belt. FIG. 1 shows a plan view of sheets 1 which are transported on a transport belt 4 in the direction of an arrow 2. Respectively after each sheet 1 is an array of line-shaped register marks 3 applied to the transport belt. In the present case, for example, respectively five register marks can be seen (3). For example (viewed against transport direction 2), initially a type of guide mark could be applied, relative to which the position of the other register marks can be determined. This register mark could preferably be applied in black, i.e., be produced by a printing unit using the "Key" color. Then follow, against transport direction 2, i.e., in the sequence of application, again one register mark, in the present case, e.g., "Key", "Yellow", "Magenta" and "Cyan" for each available printing unit of a multi-color printing machine. Additional printing units are used, for example with custom colors these printing units would also have to produce additional register marks. As an aside, it should be mentioned that this is referred to as an "application" of register marks. Basically, this could also be referred to as "printing"; however, in an electrophotographic (EP) printing machine, register marks are usually applied to the transport belt only as toner, which is not fused in order to be able to better remove it again from the transport belt at a later time. However, it could be a matter of discussion whether an electrophotographic (EP) printing includes fusing or not. In this context, the concepts "printing", "applying" and "creating" in conjunction with register marks are to be understood as being synonymous, should there be any doubt. Specifically meant is the generation of a recognizable and measurable register mark.

Figure 2:
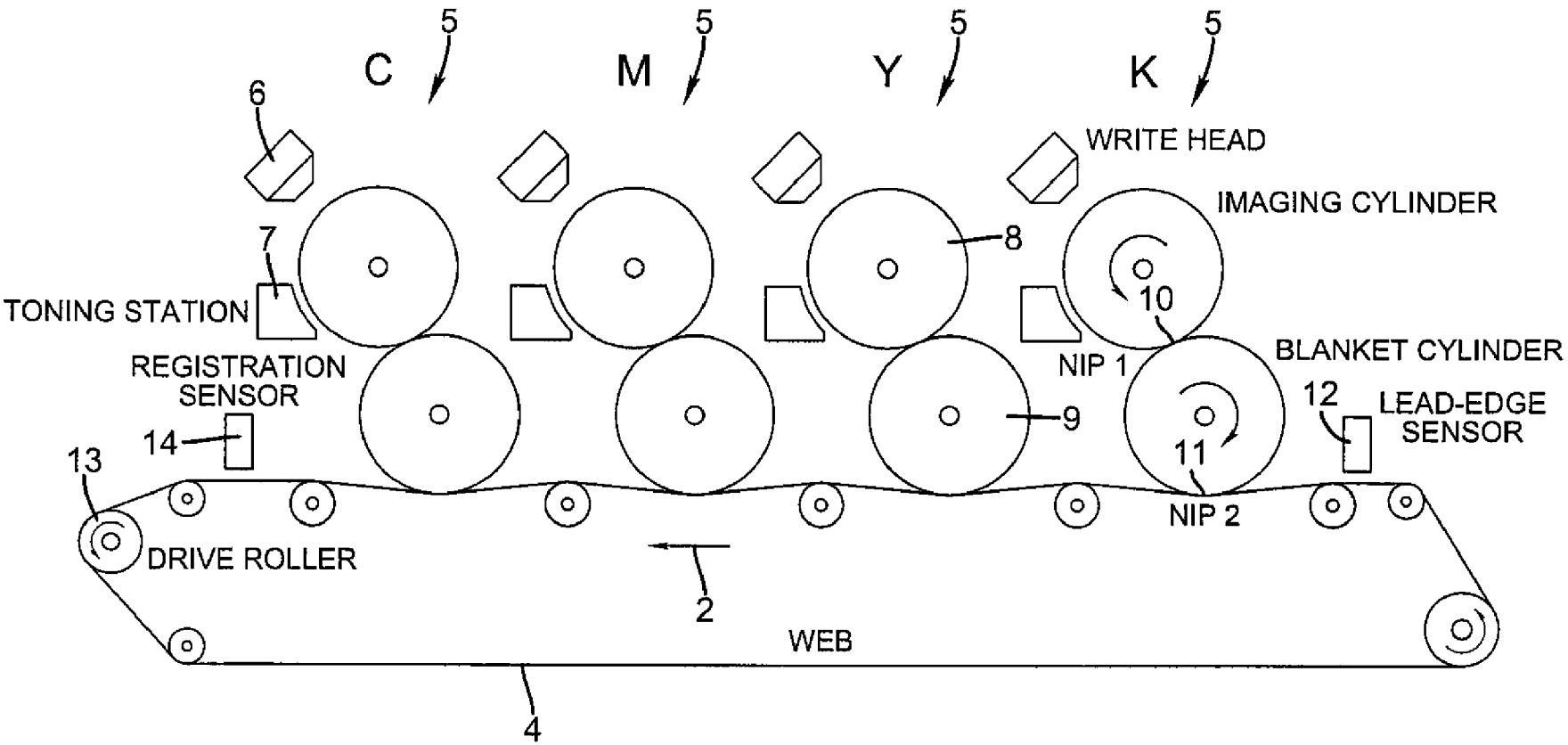
FIG. 2 shows a printer with a device and system of the present invention.

FIG. 2 shows a side elevation of a part of an EP printing machine, depicted schematically. Shown is a transport belt (web) 4 in accordance with FIG. 1, which is moved in the direction of arrow 2. Above this transport belt 4, on which sheets 1 can be transported, are four printing units or printing modules 5. These printing units 5 are labeled with the printing inks used by them, in this case abbreviated as follows: "K(Black)", "Y(ellow)", "M(agenta)" and "C(yan)". Each of these printing units 5 comprises essentially one write head 6, a toning station 6, an imaging cylinder 8, and a blanket cylinder 9. Write head 6 is used to apply the image to imaging cylinder 8, for example, by means of laser diodes, in order to create a latent printing image on imaging cylinder 8, said image being developed later with toner from toning station 7. Via a nip 10 (Nip1), this printing image is transferred to blanket cylinder 9 which transfers this printing image in a nip 11 (Nip2) to a sheet which is transported on the transport belt. The arrival of such a sheet is announced by a lead edge sensor 12, which, for example configured as a light barrier, recognizes the leading edge of the sheet. For transport, drive rollers 13 drive transport belt 4.

As already mentioned, printing units 5 also apply arrays of register marks 3 to transport belt 4, respectively after each sheet 1. These register marks are then detected by a registration sensor 14 (register mark sensor) and can thus be analyzed in according with the invention. The analysis of the register marks permits an inventive control of the subsequent printing of sheets in the same printing process. The control on the basis of a register mark that has just been detected by registration sensor 14, however, can be used at the earliest for a sheet which arrives as the next sheet at the lead edge sensor 12, because said sheet still has all the other printing units 5 ahead of it. However, because transport belt 4 is utilized better, additional sheets are already between the two sensors 12 and 14, which can no longer profit from this control, for example, six sheets in the DIN A3 format.

In accordance with the invention, the color register, such as a circumferential register or color circumferential register, determines the correct relative positions of the color separations or partial color images created by printing units 5, is monitored. To achieve this in an offset printing machine, the register marks are used to correctly position the printing units relative to each other by mechanical means. In a digital printing machine, in particular an EP printing machine like the printing machine shown in FIG. 2, the analysis of the register marks can be used more elegantly for time-corrected printing in that imaging performed by print head 6 is appropriately timed with the arrival of new information from registration sensor 14, and thus with the position of the next sheet arriving at lead edge sensor 12, and with said sheet's continued transport speed and the time of arrival in nip 11 computed there from. In so doing, it may be taken into consideration that a large part of potentially occurring register errors has already been detected by calibration runs before an actual print job, and that said errors can be and are corrected by an appropriate preliminary calibration of the printing machine.

Figure 3:
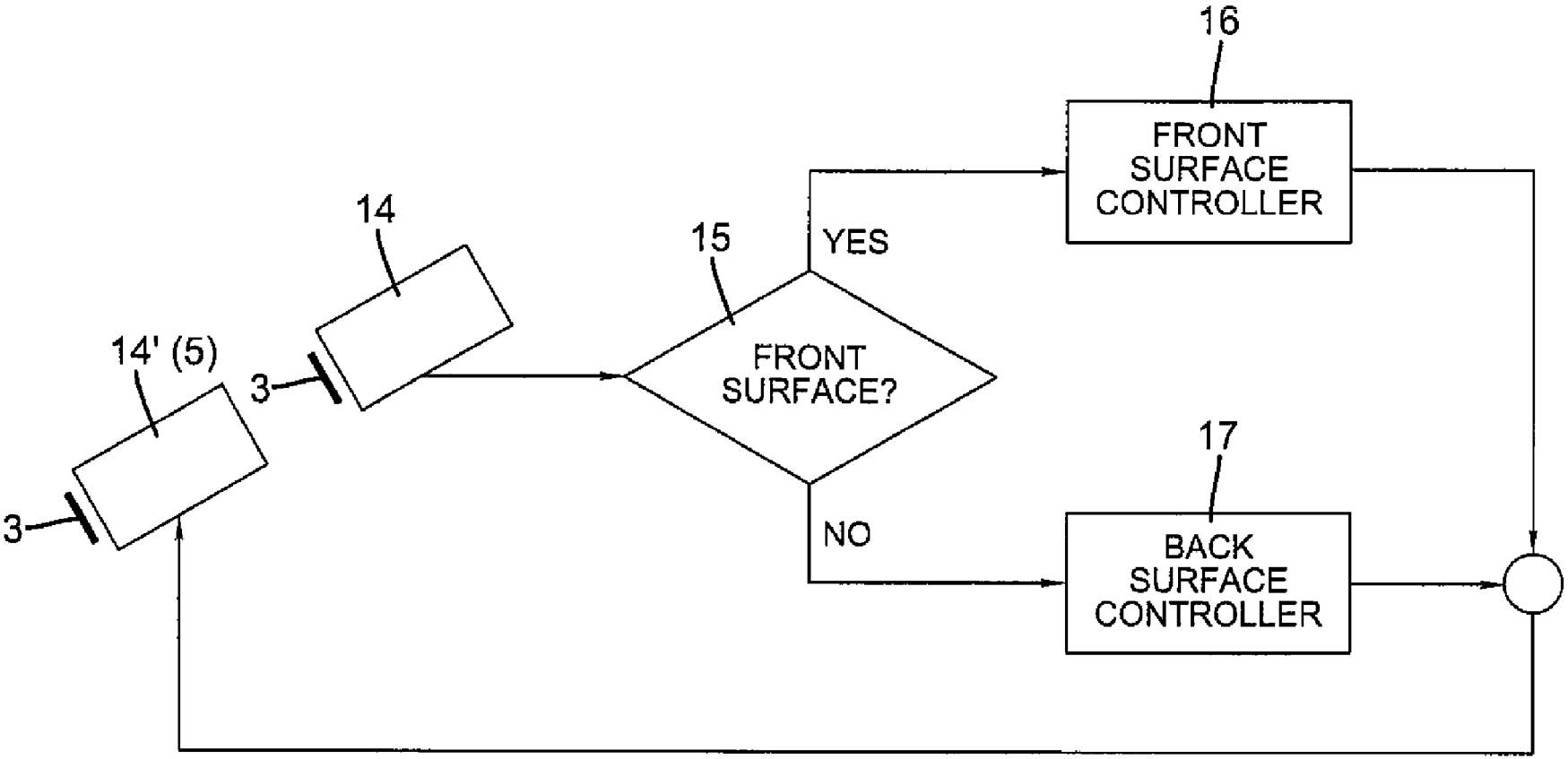
FIG. 3 is a flow diagram of the device and system of the present invention.

FIG. 3 shows a type of flow diagram of an inventive monitoring and control arrangement for control as has been described briefly above. The monitoring and control arrangement comprises, in particular, two registration sensors (14) (real) or one registration sensor 14 which performs two functions and has been quasi-virtually doubled. This registration sensor 14 detects arrays of register marks 3, which, for simplicity's sake, are indicated only as fat bars in FIG. 3. The thusly yielded registration data are forwarded by registration sensor 14 to a query means 15, which queries if data come from register marks assigned to a front surface or recto printing side of a sheet (yes) or not (no), i.e., instead of being assigned to a reverse or verso printing side. If the response is yes, the data are analyzed by a front surface controller 16; if the response is no, the data are analyzed by a back surface controller 17. Based on this, control data are released, i.e., on one hand, back to registration sensor 14' and, in particular, also to printing units 5. Also, dual controllers 16, 17 may be available, namely physically or virtually.

Figure 4:
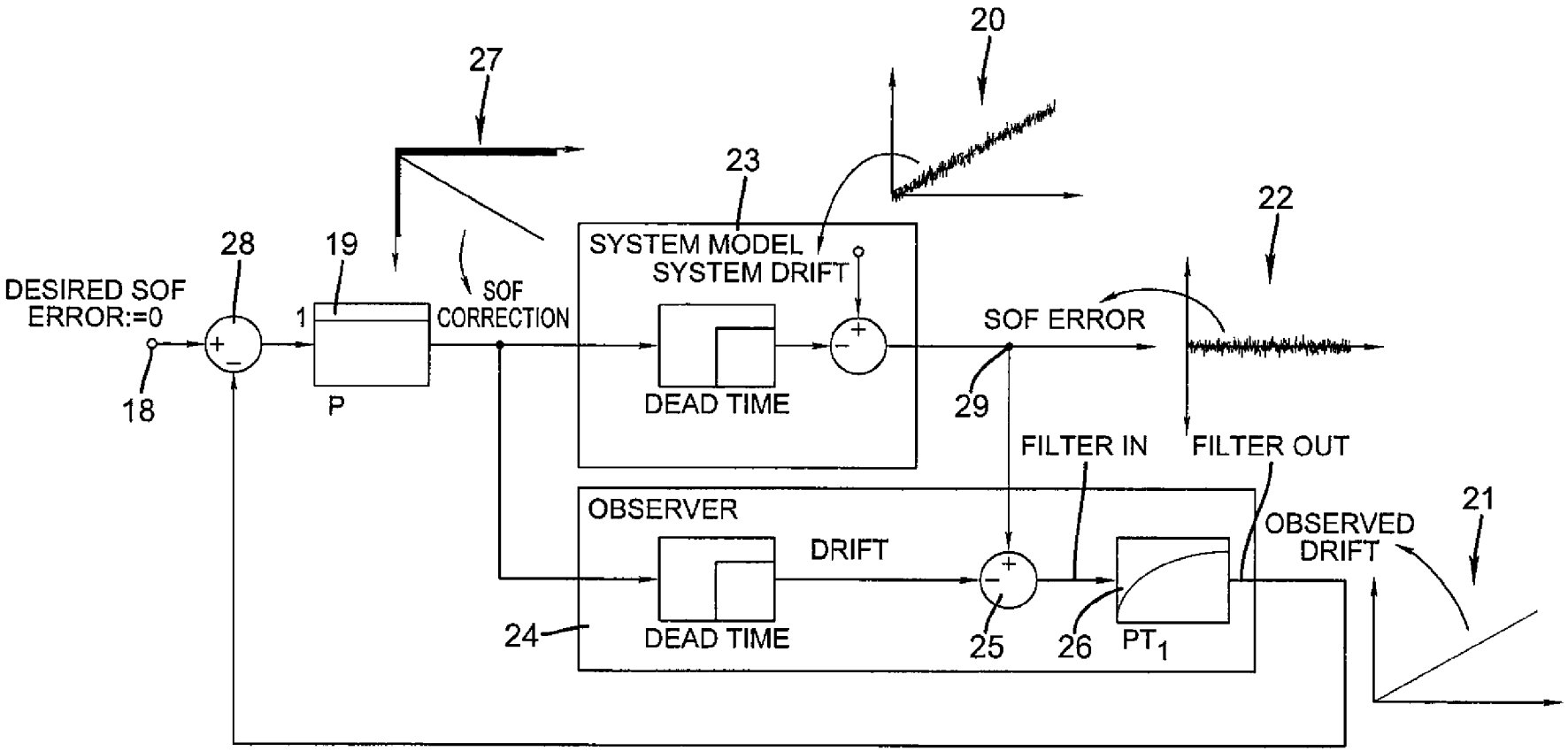
FIG. 4 shows block diagram of an embodiment of the device and system.

FIG. 4 shows a type of block circuit diagram of a monitoring and control arrangement. The characteristics of a delay drift control are the following: During the printing operation, a register mark is printed on the transport belt between respectively two printing material sheets, in which case each register mark preferably consists of a line. (At least one register mark per active printing module or printing unit is printed.) The registration sensor downstream of the last printing unit measures these marks, and, the measured values are used to determine the register, such as the circumferential register, of the sheet that directly preceded the register marks of an array. Consequently, deviations from the optimal register, ie circumferential register, are determined, and the register error of the subsequently following sheets is corrected accordingly relative to zero. This may be applicable at the earliest to the sheet, which is detected as the next sheet, for example, by a lead edge sensor.

However, it is optionally possible that a considerable path length exists in the printing machine between the aforementioned registration sensor and the aforementioned lead edge sensor. The result of this is that, directly following the measurement of a specific register mark, e.g., another six A3-size sheets having values computed in accordance with preceding measurements are printed (or are located, already partially printed, on the transport belt between the individual printing modules). Consequently, the dead time of the delay drift controller is, e.g., six A3-size sheets.

This is disadvantageous in particular when the circumferential register does not change substantially less rapidly than corresponds to the dead time of the controller. Using the known delay drift controller, the register error may possibly have a rectangular form during a print job. It is obvious that, in this case, the circumferential register during a print job is anything but optimal. Therefore, the object of the invention is to provide a method and a device of the aforementioned type, whereby said method and said device allow the improvement of register control.

Considering the method described, this object is achieved in that, in duplex printing a sheet by recto and verso printing, register marks are applied for each side, that said register marks are assigned to the respective side of the sheet and determined with respect to their position, that, in order to control recto printing of at least one subsequent sheet, the positions of register marks assigned to the recto printing side of a previous sheet are analyzed, and that, in order to control verso printing of at least one subsequent sheet, the positions of register marks assigned to the verso printing side of a previous sheet are analyzed. In accordance with the invention it has been recognized and taken into consideration that the circumferential register is disrupted synchronously to the recto and verso printing sides of a print job. This effect is particularly frequent and pronounced if, e.g., there is a significant difference in quality between the recto and verso printing sides or if the printed image content, and hence the toner application, is significantly different on both sides, e.g., considering a large picture with strong colors on the recto printing side and only a small amount of text on the verso printing side, because also the quantity of toner on the sheet changes the circumferential register. In accordance with the invention, such errors are systematically advantageously prevented or eliminated.

As a result, a single controller no longer needs to adjust to a periodically changing situation, but circumferential register errors of recto and verso printing sides can be controlled individually. If certain sheets are only to be recto-printed in the printing machine, the measured values are fed to both partial controllers (front and reverse side controllers), and the circumferential register is corrected based on the front-side controller's output.

In fact, physically separate monitoring and controlling arrangements may be provided for the analysis of register marks of the recto printing sides and on the verso printing sides, whereby said register marks are then preferably configured identically; however, one and the same monitoring and control arrangement could be used for both analyses. Specifically, a monitoring and control arrangement can be virtually doubled by software technology for the respectively separate monitoring and control of a recto print and a verso print.

Another modification of the inventive method provides that, in a normal situation, control is effected substantially in a type of control loop, in which a currently determined control step (i) is added to a previously determined control step (i-1), in which case the current control step (i) being an addend is weighted with a percentage weighting coefficient which corresponds to a filter coefficient ($a_0$), and the previously determined control step (i-1) being an addend is weighted with a percentage weighting coefficient which is equal to the difference between 100 percent and the weighting factor of the current control step (i). In so doing, it is preferred that the filter coefficient ($a_0$) is computed with an exponential function based on $1-e^x$, where the exponent x represents the negative quotient of the time ($\Delta t$) elapsed between the current control step (i) and the previous control step (i-1), and a pre-specified time constant ($\tau$).

A determined systematic drift can be introduced in a control step. In so doing, for example, the register or alignment error may additionally include a statistical distribution, whereas the systematic drift, for example, could have an approximately linear course. (Also, another functional course would be conceivable, detectable and correctable, for example, have an approximately square course.

Another modification of the inventive method provides that, in special cases, a so-called hard control is carried out, in which the current control step (i) is given greater weighting importance than would be the case in a normal control situation. Such a special case may exist, for example, when, at the start of a printing process, the current control step (i) is initially determined based on a previous calibration of the printing machine in order to be able to start with a reasonable starting parameter, i.e., before a more current value could be determined during the printing process itself, and when the control during the continued process is then adapted by a hard control—taking into consideration the greater weighting—to one of the first current control steps determined during the printing process in order to make allowances for the current printing conditions more quickly during the current printing process.

This may include that, for the hard control, the weighting factor $a_0$ itself is increased by an (artificially assumed) increase of the elapsed time ($\Delta t$) between the two control steps (i) and (i-1).

Another embodiment is for a device for controlling a circumferential register in a digital multi-color printing machine for printing sheets during a printing process, in particular in an EP printing machine, whereby, for each sheet, at least one register mark per color printing unit of the multi-color printing machine is produced, assigned to said sheet and defined with respect to its position, preferably relative to one of the color marks itself. These color marks are preferably applied to a support for the sheets and preferably downstream of the respectively associated sheet, based on the determination of the position of the register marks of a sheet, the circumferential register of at least one sheet being controlled, said sheet following the sheet associated with said determined register marks downstream of the printing process.

The device includes at least one monitoring and control arrangement for detecting register marks, for determining at least relatively the positions of said register marks and for controlling the color printing units based on the aforementioned register mark positions, said device being used preferably for carrying out the registration method for recto-printing and verso-printing both sides of sheets.

The monitoring and control arrangement is set up in such a manner that, during the detection of register marks, during the at least relative determination of the positions of these register marks and during the control of the color printing units, a distinction or differentiation based on the register mark positions can be made in order to assign the respective register mark to a recto printing side or a verso printing side of a sheet, so that, in order to control the color printing units based on the register mark positions for recto printing, only the positions of register marks assigned to a recto printing side and, for verso printing, only the positions of register marks assigned to a verso printing side can be used and taken into consideration.

The advantages resulting therefrom have already been basically described in conjunction with the inventive method. As already mentioned above, at least two control devices for detecting register marks of verso printing sides and of recto printing sides and for at least relatively determining the positions of these register marks can be provided.

It is also possible to provide at least two complete monitoring and control arrangements for the respective printing of recto printing sides and for printing verso printing sides, although, of course, the devices as such need not be substantially different from each other, so that, optionally, also a single monitoring and control arrangement could be used for both tasks. This arrangement can be virtually doubled by software for the respectively separate monitoring and control of a recto print and a verso print.

The invention, which could result in additional inventive features but does not restrict the scope of the invention, is illustrated schematically in the drawings. Referring to FIG. 4 and as already mentioned farther above, control of the circumferential registration in a digital printing machine is achieved by timed control of the image application to imaging cylinder 8 by means of write head 6.

An imagined frame is pre-specified for the imaging region on imaging cylinder 8. The time of the (chronological) beginning or start of this frame (Start of Frame—SOF) is controlled. Therefore, an error of circumferential registration can also be viewed as an SOF error, and this error should (by quasi definition) be equal to zero (NOMINAL value). This request (Desired SOF error:=0) is used at point 18 on entry into the monitoring and control arrangement in FIG. 4. In the illustrated control loop, a proportionality link 19 is labeled "P" only for the sake of completeness, which said link, in the present case, only multiplies an observed value 21 as control deviation—after it has been inverted at 28—with a proportionality factor "1", i.e., remains unchanged, so that the observed value 21 becomes setting value 27, as indicated. How this observed value 21 or setting value 27 is determined or yielded will be described in detail hereinafter.

In a model of the viewed or observed system (system model) 23, it is assumed, using a controlled system as basis, that within the already described "dead time", during which a sheet moves from lead edge sensor 12 to registration sensor 14 and is processed by printing units 5, the circumferential register assigned to this sheet is subject to a drift and to statistical noise, in which case said drift is to be quasi counter-controlled by reverse "presentation" for correction. For example, a substantially linear systematic drift (system drift) is assumed, which said drift is superimposed by said noise and over time leads to position changes of the register marks, as illustrated in region 20. This is the ACTUAL value which is generated in the system and which is present at point 29. If the drift is corrected out, as shown in region 22, only the statistical noise round the requested NOMINAL zero value (SOF value) remains, whereby said noise cannot be further removed by correction.

In order to achieve the desired control, the system is reproduced on the side of an "observer" via the control loop. On the observer 24 side of the observed system, the drift of the system is observed and taken into account in point 25 via the ACTUAL value obtained in point 29. In order to synchronize the observer with the system, the dead time already mentioned in conjunction with system model 23 must be taken into consideration.

The ACTUAL value obtained at point 25 from the system, as shown in region 20, is input—in order to smooth said value and eliminate the noise—as filter input data (FilterIn) in a filter 26 labeled "$PT_1$", said filter being essentially configured or acting as a low-pass filter. This is achieved by means of the following FilterIn algorithm shown below:

$$FilterIn(i) = DriftCorrection(i-d) - RegError(i) = DriftCorrection(i-d) - \{RegData(i) - DesiredValue\} \quad (1)$$

with the current control step i and dead time d. The parameters of said algorithm are largely self-explanatory, i.e., "FilterIn" represents the input value for filter 26, "DriftCorrection" represents the drift to be corrected in view of the dead time, "RegError" represents the registration error to be corrected, "RegData" represents the registered register mark data (ACTUAL values), and "DesiredValue" represents the desired register mark data (SET values). In so doing, the determination of the difference (i−d) takes into consideration that correction starts in the region of lead edge sensor 12, i.e., registered by dead timed earlier than the registration of register mark data in the region of registration sensor 14 (at "time" i). This determination of the difference can also be understood as the determination of the average over this period of time.

The FilterOut then results due to filter 26 in terms of:

$$\text{FilterOut}(i)=a_0\cdot\text{FilterIn}(i)+(1-a_0)\cdot\text{FilterOut}(i-1) \quad (2)$$

with the current control step i and the previous control step (i-1).

$a_0$ is a filter coefficient expressed in terms of:

$$a_0 = 1 - \exp\left(-\frac{\Delta t}{\tau}\right) \quad (3)$$

where Δt is the time between the current and the previous control steps t(i)−t(i-1), and τ is a time constant of filter 26. Considering an artificial prespecified value, in particular an increase of Δt, the value of the filter coefficient or the weighting factor $a_0$ can be varied and, thus, also portions of the two addends in equation (2) can be prespecified. This determines the degree of the "hardness" or "softness" that is being considered in view of current or previous data during control. In particular at the start of a printing process, initially a harder control should be preferable.

Finally, in equation (2), the FilterOut value, which is represented as the observed value (Observed Drift) and is shown in region 21, and the smoothed drift which has been freed of noise, as described above, are taken into consideration for the next control at point 28 in terms of:

$$\text{DriftCorrection}(i)=\text{FilterOut}(i) \quad (4)$$

The invention has been described in detail with particular reference to certain preferred embodiments thereof, but it will be understood that variations and modifications can be effected within the spirit and scope of the invention.

The invention claimed is:

1. A method of controlling a register in a digital multi-color electrophotographic (EP) printing machine for printing sheets on a support during a printing process comprising:

applying one or more color marks to the support for said sheets downstream of a respectively associated first sheet;

applying at least one assigned register mark per color to a first sheet defined relative to a register mark position of a color register mark; and controlling the printing process based on a position of one or more register marks on a second subsequent sheet, that follows the first sheet, in duplex printing so that recto and verso register marks are handled separately by determining the recto and verso register marks on each side by analyzing the respective recto and verso mark position on at least one previous sheet.

2. The method of claim 1, wherein a determined systematic drift is introduced in a control step.

3. The method of claim 1, further comprising a weighting factor $a_0$ That is increased by an increase of the elapsed time (Δt) between a current first control step (i) and a previous control step (i-1).

4. The method of claim 1, wherein one or more of the register marks is controlled by a circumferential register.

5. The method of claim 1, wherein controlling comprises a control loop, in which a currently determined control step (i) is added to a previously determined control step (i-1), said current control step (i) being an addend weighted with a percentage weighting coefficient which corresponds to a filter coefficient ($a_0$), and the previously determined control step (i-1) being an addend weighted with a percentage weighting coefficient which is equal to the difference between 100 percent and the weighting factor of the current control step (i).

6. The method of claim 5, wherein the filter coefficient ($a_0$) is computed with an exponential function $1-e^x$, where the exponent x represents the negative quotient of the time (Δt) elapsed between the current control step (i) and the previous control step (i-1), and a pre-specified time constant (τ).

7. The method of claim 5, wherein a hard control is performed, in which the current control step (i) is given greater weighting importance than would be the case in a normal control situation.

8. The method of claim 5, further comprising a weighting factor $a_0$ itself is increased by an increase of the elapsed time (Δt) between the current control step (i) and the previous control step (i-1).

9. The method of claim 5, wherein at the start of a printing process, the current control step (i) is determined based on a previous calibration of the printing machine, and that the control during the continued process is then adapted by a hard control, taking into consideration the greater weighting, to one of the first current control steps determined during the printing process.

10. A device for controlling a register in a digital multi-color electrophotographic (EP) printing machine for printing sheets on a support during a printing process comprising:

a controller for applying one or more color marks to the support for said sheets downstream of a first sheet and applying at least one register mark per color to the first sheet relative to one of the color marks based on the position of the register marks of the first sheet;

a register to store the calculated position of said determined position of said recto and verso register marks relative to color marks on the same sheet;

a monitoring device, interacting with the controller, for controlling printing by detecting the register marks and for determining at least relatively the positions of said register marks and for controlling the color printing units based on the aforementioned register mark positions, such that for recto-printing and verso-printing each side of the sheets are monitored separately, by differentiating each recto and verso register mark position and controlling the printer based only on the positions of register marks assigned to a recto printing side and or a verso printing side.

11. The device according to claim 10, further comprising at least two control devices for detecting register marks of the verso printing sides and that of recto printing sides respectively and for at least relatively determining the positions of these register marks are provided.

12. The device according to claim 10, further comprising at least two complete monitoring and control arrangements for the respective printing of recto printing sides and for printing verso printing sides are provided.

13. The device of claim 10, wherein the controller further determines systematic drift during the control step.

14. The device of claim 10, the controller further comprising a stored weighting factor $a_0$ that is increased by an increase of the elapsed time ($\Delta t$) between a current first control step (i) and a previous control step (i-1).

15. The device of claim 10, wherein one or more of the registers is a circumferential register.

16. A method for improving the quality of duplex prints using a printing device comprising:

controlling registration during printing by controlling the registration of at least one sheet, which follows the sheet associated with one or more marks;

printing in duplex on a sheet by recto and verso printing such that register marks are applied on each side in order to control the recto and verso printing of at least one subsequent sheet by analyzing the associated registration marks.

* * * * *